US006156131A

United States Patent [19]

Sardoy et al.

[11] Patent Number: 6,156,131

[45] Date of Patent: Dec. 5, 2000

[54] PROCESS FOR MANUFACTURING A STRIP OF STEEL SHEET FOR THE PRODUCTION OF METAL PACKAGING BY DRAWINGS AND STEEL SHEET OBTAINED

[75] Inventors: Véronique Sardoy, Metz; Jean Claude Jouvenel, Basse Indre; Jacques Ouvrard, Nantes, all of France

[73] Assignee: Sollac, Puteaux, France

[21] Appl. No.: 09/166,126

[22] Filed: Oct. 5, 1998

[30] Foreign Application Priority Data

Oct. 3, 1997 [FR] France ..... 9712375

[51] Int. Cl.[7] ..... C21D 8/04; C22C 38/04

[52] U.S. Cl. ..... 148/320; 148/651

[58] Field of Search ..... 148/320, 651

[56] References Cited

FOREIGN PATENT DOCUMENTS 403249133 11/1991 Japan ..... 148/651
405112829 5/1993 Japan ..... 148/651
405345925 12/1993 Japan ..... 148/651

*Primary Examiner*—Deborah Yee
*Attorney, Agent, or Firm*—Oblon, Spivak, McClelland, Maier & Neustadt, P.C.

[57] ABSTRACT

A process for producing a strip of steel sheet, for the production of metal packaging, comprising forming a hot-rolled strip of steel having the following composition by weight: carbon up to 0.08%, silicon ≦0.020%, manganese between 0.05% and 0.60%, sulphur ≦0.020%, phosphorus ≦0.020%, nitrogen up to 0.016%, aluminum up to 0.060%, copper ≦0.06%, nickel ≦0.040%, and, optionally, chromium and boron, the balance consisting of iron and inevitable impurities, then carrying out a first cold-rolling operation on the hot-rolled strip in order to obtain a blank, subjecting the blank to a continuous recrystallization annealing operation, carrying out a second cold-rolling operation on the blank in at least two passes in order to obtain the sheet with its final thickness, wherein between the two passes of the second cold rolling, the strip of sheet is subjected to an ageing operation at a temperature of at most 300° C. for a time which can range from a few minutes to several days.

22 Claims, No Drawings

PROCESS FOR MANUFACTURING A STRIP OF STEEL SHEET FOR THE PRODUCTION OF METAL PACKAGING BY DRAWINGS AND STEEL SHEET OBTAINED

BACKGROUND OF THE INVENTION

1. Field of the Invention

The invention relates to a process for manufacturing a strip of steel sheet for the production of metal packaging and the sheet obtained by the process.

2. Discussion of Background

In order to manufacture steel packaging products by drawing, such as cans for food products or for drinks, blanks cut from thin sheets are used. These sheets must have good formability to that they can be drawn and they must also have good mechanical strength depending on their end use.

It is necessary to obtain sheets having good mechanical properties, in particular a high mechanical strength and a high yield stress, in order to produce bottoms or bodies of very-high-performance metal cans, and also in the case of very thin sheets for the production of certain types of packaging.

In particular, double-reduction (DR)-type sheets whose mechanical strength is greater than or equal to 550 MPa are obtained from hot sheets, by successively carrying out a first cold-rolling operation, an operation of annealing, generally continuous annealing, of the cold-rolled sheet and then a second cold-rolling operation comprising two successive passes generally carried out on a skin-pass mill.

However, the high mechanical properties of the sheets are obtained to the detriment of the formability of these sheets after the second pass of the final cold rolling. It is desirable to remedy this drawback.

In particular, it is desirable to obtain sheets which have high mechanical properties and good drawability at necking.

The level of mechanical properties of the sheet, which is obtained after the second cold rolling, depends on the reduction ratio or draw ratio of the sheet obtained during the two passes of the second rolling. Of course, in the case of high draw ratios, the high work hardening of the sheets is accompanied by a poor formability.

The double-reduction process, which involves a second cold-rolling operation in two passes after the sheets have been annealed, has been applied to grades of packaging steel, both of the ultra-low-carbon (ULC) type, the carbon content of which is less than 0.008%, and to steels of other types, for example low-renitrided-aluminium steels containing from 8 to 16 thousandths of a per cent of nitrogen. In all cases, obtaining higher mechanical properties means a decrease in the formability.

SUMMARY OF THE INVENTION

The object of the invention is therefore to provide a process for manufacturing a strip of steel sheet for the production of metal packaging by drawing, in which:

a hot-rolled strip is produced, this being made of a steel comprising iron and the following elements by weight, based on total weight:

carbon up to 0.08%, silicon ≦0.020%, manganese between 0.05% and 0.60%, sulphur ≦0.020%, phosphorus ≦0.020%, nitrogen up to 0.016%, aluminum up to 0.060%, copper ≦0.06%, nickel ≦0.040%, The steel may also comprise chromium and boron and residual impurities.

The process comprises a first cold-rolling operation which is carried out on the hot-rolled strip in order to obtain a blank, this blank is then subjected to a continuous recrystallization annealing operation, followed by a second cold-rolling operation which is carried out on the blank in at least two passes in order to obtain a strip of packaging sheet with its final thickness. This process makes it possible to obtain mechanical properties at least as high as those in the case of double-reduction manufacturing processes with a lower work-hardening of the sheet and therefore a better formability.

To this end, between the two passes of the second cold-rolling operation, the strip of steel sheet is subjected to an ageing operation at a temperature and for a time sufficient to form a first dislocation network in the sheet. Preferably, the temperature ranges from 20–300° C. and the time ranges from a few minutes to several days. More preferably, from 10 minutes to 10 days.

In general, the ageing may be carried out at an ambient temperature of about 20° C. for a time of 3 to 10 days, at a moderate temperature of between 50 and 100° C. for a time of 1 to 5 hours, or else, at a higher temperature, of between 150 and 300° C., for a time of between 10 minutes and 1 hour. For example, the ageing treatment may be carried out at a temperature of about 75° C. for a time of 30 minutes to 3 hours or at a temperature of about 200° C. for a time of about 20 minutes.

Although ageing for a long time at ambient temperature is satisfactory, it is preferable to carry out the ageing at a higher temperature for a shorter time.

In general, it appears that intermediate ageing is more rapid the higher the ageing temperature. However, significant ageing may be obtained at ambient temperature.

It has been demonstrated that the intermediate ageing between the two passes of the final cold rolling is greater and more rapid the higher the content of the elements in the steel after annealing, in particular after continuous annealing. It has also been demonstrated that the intermediate ageing was greater and more rapid the higher the draw ratio or reduction ratio during the first pass of the second cold rolling. It is therefore advantageous to carry out the first pass with a high reduction ratio and the second pass with a lower reduction ratio, for a given total reduction ratio.

The improvement in the mechanical properties of the sheets because of the ageing treatment between the two passes of the final cold rolling may be explained by the mechanisms described below.

During the first pass of the skin-pass rolling, a dislocation network is created in the sheet and, during the subsequent ageing treatment, the elements such as carbon and nitrogen diffuse into the steel and cause pinning of the dislocations, to form a first dislocation network.

During the second pass of the skin-pass rolling, a new dislocation network or second dislocation network is created.

For the same skin-pass total deformation ratio, a completely new configuration of the dislocation network in the sheet is obtained.

This new configuration of the dislocation network explains why, for defined mechanical properties, better formability is obtained or why, while maintaining good formability, superior mechanical properties are obtained.

The invention applies to all Al—K sheet steels, i.e. aluminium-killed steels, without any carbide-forming and/or nitride-forming elements, when these sheet steels are continuously annealed.

The sheets obtained by the process of the invention may be used in all applications of DR-quality packaging sheets. In particular, the sheets may be cut in order to produce blanks intended for the manufacture of two-piece or three-piece can bodies or bottoms having good mechanical properties.

Because of their improved mechanical properties, the sheets obtained by the process according to the invention may be used in smaller thicknesses.

DESCRIPTION OF THE PREFERRED EMBODIMENTS

In particular, the invention applies to low-renitrided-aluminium steels comprising iron and the following elements by weight based on total weight:

carbon between 0.05 and 0.08% manganese between 0.200 and 0.450%, aluminium <0.020%, nitrogen between 0.008 and 0.016%, sulphur <0.020%, silicon <0.020%.

In this case, the ageing treatment is preferably carried out at a temperature close to 20° C. for a time of 3 to 10 days, or at a moderate temperature of between 50 and 100° C. for a time of 5 to 15 hours, or alternatively at a higher temperature of between 150 and 300° C. for a time of between 10 minutes and 1 hour.

The invention also applies to ultra-low-carbon steels. Ultra-low-carbon steels are generally characterized by a chemical composition comprising iron, residual impurities from the smelting process, and the following elements by weight based on total weight:

carbon <0.006%, silicon <0.02%, 0.15% ≦manganese ≦0.25%, sulphur ≦0.015%, phosphorus ≦0.017%, nitrogen ≦0.006%, aluminum between 0.02% and 0.04%.

In general, in the case of an ultra-low-carbon steel, the ageing is preferably carried out at an ambient temperature of about 20° C. for a time of 3 to 10 days, at a moderate temperature of between 50 and 100° C. for a time of 1 to 5 hours, or else, at a higher temperature, of between 150 and 300° C., for a time of between 10 minutes and 1 hour. For example, the ageing treatment may be carried out at a temperature of about 75° C. for a time of 30 minutes to 3 hours or at a temperature of about 200° C. for a time of about 20 minutes.

Having generally described the invention, a further understanding can be obtained by reference to certain specific examples which are provided herein for purposes of illustration only and are not intended to be limiting unless otherwise specified. In the following two examples, the strip of steel is made of aluminum-killed steel containing no carbide-forming and/or nitride-forming element.

EXAMPLE 1

The case of an ultra-low-carbon (ULC) steel.

An ULC steel containing in particular (in thousandths of a percent) C=3.5; N=6.5; Mn=185 and Al=33 was smelted. The steel was continuously cast in the form of a slab which was hot rolled. The hot-rolled strip underwent a first cold-rolling operation in order to convert it into a blank with a thickness of 0.24 mm.

The blank was subjected to a second cold-rolling operation in a skin-pass mill.

Reference will be made to Table I which gives the treatments carried out on the sheet during the second cold rolling.

TABLE I

| Sheet ref. | Draw ratio, 1st pass | HT | $R_e$ (MPa) | Draw ratio, 2nd pass | Total draw ratio | $R_e$ (MPa) after SP | $R_e$ (MPa) after 200° C./ 20 min. |
|---|---|---|---|---|---|---|---|
| A | | | | | 43% | 562 | 606 |
| B | 31% | | 527 | 9% | 43% | 558 | 610 |
| C | 31% | 20° C./ 10 d | 568 | 9% | 43% | 594 | 648 |
| D | 31% | 75° C./ 30 min. | 561 | 9% | 43% | 605 | 648 |
| E | 31% | 75 ° C./ 3 h | 552 | 9% | 43% | 616 | 665 |
| F | 31% | 200° C./ 20 min. | 565 | 9% | 43% | 616 | 668 |
| G | 31% | 20° C./ 3 d | 560 | 9% | 43% | 589 | 621 |

The sheets designated by the references A and B have not been subjected to a treatment according to the invention. Sheets A and B obtained from the skin-pass second cold rolling are designated as comparative sheets.

On the other hand, the sheets designated by the references C to G have been subjected, according to the process of the invention, to a two-pass second cold rolling operation with ageing between the two passes of the skin-pass rolling.

In all cases, the total draw of the sheet is 43%, this draw being obtained in a single pass in the case of sheet A.

The draw is obtained in two passes (draw ratios of 31 and 9%, respectively) without any intermediate ageing treatment between the two passes in the case of sheet B.

Sheet C is subjected to ageing for 10 days at 20° C. and sheet D is subjected to an ageing treatment at 75° C. for 30 minutes between the two cold-rolling passes.

An ageing heat treatment lasting 3 hours at 75° C. was carried out on sheet E between the two passes of the final cold rolling with draw ratios of 31 and 9%.

An ageing treatment at 200° C. for 20 minutes is carried out between the two passes of the skin-pass final cold rolling (draw ratios of 31 and 9%) in the case of sheet F and sheet G is subjected to ageing for three days at 20° C. between the two passes of the final rolling.

The yield stress of the sheets in MPa was measured, following the heat treatment after the first pass of the skin-pass cold rolling when two rolling passes are carried out (sheets B to G); the corresponding yield stresses are given in the fourth column of Table I.

The yield stresses of the sheets were also measured immediately on leaving the skin-pass mill (7th column of Table I) and after the sheet was held for 20 minutes at 200° C. after it has left the skin-pass mill (8th column of Table I).

It appears that in all cases the high draw ratio (43%) of the sheet during the skin-pass second rolling carried out makes it possible to obtain, on leaving the skin-pass mill, a high yield stress which is always greater than 550 MPa, this yield stress being greater than 600 MPa after 20 minutes at 200° C.

For the same total draw ratio, the yield stresses obtained are slightly greater when the skin-pass final rolling is carried out in two passes (with draw ratios of 31 % and 9%, respectively). Sheet B, which is produced using a two-pass second rolling operation, therefore has mechanical properties after 20 minutes at 200° C. which are slightly greater than those of sheet A which is produced using only a single-pass second rolling operation.

According to the invention, an additional improvement is made by an ageing treatment between the two rolling passes of the final rolling.

As may be seen in the fourth column of Table I, the yield stress between the two rolling passes is considerably increased by an ageing treatment, as is apparent from comparing the yield stresses of sheets C to G with the yield stress of sheet B.

No appreciable difference between ageing at a moderate temperature of 75° C. for three hours and ageing at a higher temperature of 200° C. for 20 minutes is detected, or between ageing at ambient temperature (20° C.) for 3 or 10 days and ageing at 75° C. for 30 minutes.

After the second rolling pass, the yield stresses, immediately on leaving the skin-pass mill or after 20 minutes at 200° C., are further increased because of the work hardening caused by the second rolling pass.

The final yield stresses obtained on sheets C to G, produced according to the invention, are substantially higher than the final yield stresses of sheets A and B obtained by a single-pass second rolling process (sheet A) or a two-pass second rolling process according to the prior art (sheet B), the total draw ratio being the same in all cases.

For the same total work hardening of the sheet, the process according to the invention therefore makes it possible to obtain superior mechanical properties. Because the formability of the sheet and, in particular, the drawability depend on the work hardening, sheets may be obtained which have both satisfactory forming characteristics and high mechanical properties.

It is also be possible to obtain sheets having the same mechanical properties as sheets obtained by a conventional double-reduction manufacturing process with a lower total draw ratio and therefore with less work hardening, by carrying out an ageing treatment between two passes of the final rolling. For given mechanical properties, the formability of the sheets is in this case improved.

EXAMPLE 2

A low-renitrided-aluminium steel containing in particular (in thousandths of a percent) C=64; N=9.1; Mn=285 and Al=15 was produced. A hot-rolled strip is produced and the strip is then rolled by a double-reduction process, the skin-pass final rolling of which is carried out with a total draw of 28%.

As may be seen in Table II, four sheets having the composition given above were produced by a double-reduction process, the second cold rolling of which is carried out in the skin-pass mill with a draw ratio of 28%.

TABLE II

| Sheet ref. | Draw ratio 1st pass | HT | $R_e$ (MPa) | Draw ratio, 2nd pass | Total draw ratio | $R_e$ (MPa) after SP |
|---|---|---|---|---|---|---|
| A' | | | | | 28% | 570 |
| B' | 20% | 20° C./3 d | 601 | 6% | 28% | 595 |
| C' | 20% | 75° C./10 h | 600 | 6% | 28% | 635 |
| D' | 20% | 200° C./20 min. | 630 | 6% | 28% | 625 |

Sheet A' is produced by a production process according to the prior art while sheets B', C' and D' are produced by a process according to the invention.

In the case of sheet A', the second cold rolling is carried out in a single pass with a draw ratio of 28%.

The yield stress of the sheet on leaving the skin-pass mill is 570 MPa.

Sheets B', C' and D' were produced by a process according to the invention in which the second cold rolling is carried out in two passes (20% and 6% draw ratios, respectively) with an aging heat treatment between the two passes.

The processes for producing sheets B', C' and D' differ by the conditions under which the heat treatment is carried out between the two passes of the final rolling.

Sheet B' was aged at an ambient temperature of 20° C. for three days. Sheet C' was aged at a moderate temperature of 75° C. for 10 hours and sheet D' was aged at a higher temperature of 200° C. for 20 minutes.

The yield stresses obtained on leaving the skin-pass mill after the second rolling pass producing a draw of 6% are all greater than the yield stress of sheet A' obtained by skin-pass rolling in a single pass.

The invention is not limited to the embodiments which have been described.

The total draw ratio during the second cold rolling may differ from the draw ratios indicated above. Likewise, the distribution of the percentage draw between the first and second pass of the second cold rolling may differ from the distributions given above.

It is even possible to carry out a second cold rolling operation with a higher draw ratio during the second pass than during the first, although this distribution of the deformations is less favorable than the distribution mentioned above, i.e. with a draw during the first pass of the second rolling which is greater than the draw during the second pass of the second rolling.

In the case of an ultra-low-carbon steel, the second cold rolling is preferably carried out with a draw ratio of between 25% and 35% during the first rolling pass and with a draw ratio of less than 15% and preferably between 5% and 10% during the second rolling phase.

In the case of a low-renitrided-aluminum steel, the second rolling is preferably carried out with a draw ratio of between 15% and 25% during the first rolling pass and a ratio of less than 10% during the second pass of the second cold rolling.

Finally, the process according to the invention may be applied to the manufacture of thin metal strips intended for the production of metal packaging in grades differing from the ultra-low-carbon or low-renitrided-aluminum grades which have been described above.

Having now fully described the invention, it will be apparent to one of ordinary skill in the art that many changes and modifications can be made thereto without departing from the spirit or scope of the invention as set forth herein.

French patent application 97 12375, filed on Oct. 3, 1997 and from which this application claims priority, is hereby incorporated by reference.

What is claimed as new and desired to be secured by Letters Patent of the United States is:

1. A process for manufacturing a strip of steel sheet comprising:

(a) producing a hot-rolled strip of steel comprising iron and the following elements by weight, based on total weight:
carbon up to 0.08%,
silicon ≦0.020%,
manganese between 0.05% and 0.60%,
sulphur ≦0.020%, phosphorus ≦0.020%,
nitrogen up to 0.016%,
aluminum up to 0.060%,
copper ≦0.06%, and
nickel ≦0.040%;

(b) cold-rolling the hot-rolled strip of steel to obtain a blank;

(c) subjecting the blank to a continuous recrystallization annealing operation; and then (d) cold-rolling the blank in at least two passes to obtain a strip of steel sheet, wherein between the two passes of the second cold-rolling operation, the strip of steel sheet is subjected to ageing at a temperature and for a time sufficient to pin a first dislocation network produced by the first pass of the second cold-rolling, and wherein a second dislocation network is produced by the second pass of the second cold-rolling.

2. The process according to claim 1, wherein the steel is an ultra-low-carbon steel comprising iron and the following elements by weight based on total weight:

carbon ≦0.006%,
silicon ≦0.02%,
0.15% ≦manganese ≦0.5%,
sulphur ≦0.015%,
phosphorus ≦0.017%,
nitrogen ≦0.006%,
aluminum between 0.02% and 0.04%, and wherein the second cold-rolling operation is carried out with a draw ratio of between 25% and 35% during the first rolling pass and with a draw ratio of less than 15% during the second rolling pass.

3. The process according to claim 2, wherein the draw ratio is between 5 and 10 % during the second rolling pass.

4. The process according to claim 2, wherein the ageing is carried out either at a temperature of between 50° and 100° C., for a time of between 1 and 5 hours, or else at a temperature of between 150° and 300° C., for a time of between 10 minutes and 1 hour.

5. The process according to claim 3, wherein the ageing is carried out either at a temperature of between 50° and 100° C., for a time of 1 to 5 hours, or else at a temperature of between 150° and 300° C., for a time of between 10 minutes and 1 hour.

6. The process according to claim 2, wherein the ageing is carried out at a temperature of about 75° C. for a time of between 30 minutes and three hours.

7. The process according to claim 3, wherein the ageing is carried out at a temperature of about 75° C. for a time of between 30 minutes and three hours.

8. The process according to claim 3, wherein the ageing is carried out at a temperature of about 200° C. for a time of about 20 minutes.

9. The process according to claim 4, wherein the ageing is carried out at a temperature of about 200 ° C. for a time of about 20 minutes.

10. The process according to claim 2, wherein the ageing is carried out at an ambient temperature of about 20° C. for a time of 3 to 10 days.

11. The process according to claim 3, wherein the ageing is carried out at an ambient temperature of about 20° C. for a time of 3 to 10 days.

12. The process according to claim 1, wherein the steel is a renitrided low-aluminum steel comprising iron and the following elements by weight based on total weight:

carbon between 0.05 and 0.08%
manganese between 0.200 and 0.450%,
aluminum <0.020%,
nitrogen between 0.008 and 0.016%,
sulphur <0.020%,
silicon <0.020%, and wherein the second cold rolling is carried out with a draw ratio of between 15 and 25% during the first rolling pass and a draw ratio of less than 10% during the second rolling pass.

13. The process according to claim 12, wherein the ageing is carried out either at a temperature of about 20° C. for a time of 3 to 10 days, or at a temperature of between 50 and 100° C. for a time of 5 to 15 hours, or else at a temperature of between 150 and 300° C. for a time of between 10 minutes and 1 hour.

14. A strip of steel sheet produced by the process of claim 1, having a first network of dislocations formed during the first pass of the second cold rolling and a second network of dislocations formed during the second pass of the second cold rolling.

15. A strip of steel sheet produced by the process of claim 2, having a first network of dislocations formed during the first pass of the second cold rolling and a second network of dislocations formed during the second pass of the second cold rolling.

16. A strip of steel sheet produced by the process of claim 12, having a first network of dislocations formed during the first pass of the second cold rolling and a second network of dislocations formed during the second pass of the second cold rolling.

17. The strip of steel sheet according to claim 14, having a yield stress of 589 MPa or greater.

18. The strip of steel sheet according to claim 15, having a yield stress of 589 MPa or greater and a draw ratio after the second pass of the second cold rolling which is 9% or less.

19. The strip of steel sheet according to claim 16, having a yield stress of 595 MPa or greater and a draw ratio after the second pass of the second cold rolling which is 6% or less.

20. The strip of steel sheet according to claim 17, wherein the draw ratio of the steel after the second pass of the second cold rolling is 9% or less.

21. The process according to claim 1, wherein said ageing is performed at a temperature of between 20–300° C.

22. A cold-rolled strip of steel sheet comprising iron and the following elements by weight, based on total weight:

carbon up to 0.08%,
silicon ≦0.020%,
manganese between 0.05% and 0.60%,
sulphur ≦0.020%,
phosphorus ≦0.020%,
nitrogen up to 0.016%,
aluminum up to 0.060%,
copper ≦0.06%, and
nickel ≦0.040%;

wherein said sheet is characterized by first and second dislocation networks produced by cold rolling.

* * * * *